US008636354B2

(12) United States Patent
Fujisawa

(10) Patent No.: US 8,636,354 B2
(45) Date of Patent: Jan. 28, 2014

(54) LIQUID EJECTING APPARATUS

(71) Applicant: Seiko Epson Corporation, Tokyo (JP)

(72) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/710,860

(22) Filed: Dec. 11, 2012

(65) Prior Publication Data

US 2013/0100220 A1 Apr. 25, 2013

Related U.S. Application Data

(63) Continuation of application No. 12/828,829, filed on Jul. 1, 2010, now Pat. No. 8,353,590.

(30) Foreign Application Priority Data

Jul. 2, 2009 (JP) ..... 2009-158044

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS

| | | | | |
|---|---|---|---|---|
| 6,550,905 | B1 * | 4/2003 | Deckers | 347/100 |
| 2005/0190248 | A1 | 9/2005 | Konno et al. | |
| 2005/0200676 | A1 * | 9/2005 | Kadomatsu et al. | 347/102 |
| 2008/0074481 | A1 | 3/2008 | Doo | |
| 2009/0148209 | A1 | 6/2009 | Ikegami | |

FOREIGN PATENT DOCUMENTS

| | | |
|---|---|---|
| JP | 08-108530 | 4/1996 |
| JP | 2000-158793 | 6/2000 |
| JP | 2003-191593 | 7/2003 |
| JP | 2007-030525 | 2/2007 |
| JP | 2007-245732 | 9/2007 |
| JP | 2009-137141 | 6/2009 |

* cited by examiner

*Primary Examiner* — Stephen Meier
*Assistant Examiner* — Tracey McMillion
(74) *Attorney, Agent, or Firm* — Workman Nydegger

(57) ABSTRACT

A liquid ejecting apparatus includes: a head that ejects liquid to be cured by receiving irradiation of an electromagnetic wave onto a medium; a provisional-curing irradiation section that emits a first electromagnetic wave to a dot formed on the medium by the liquid; and a main-curing irradiation section that emits a second electromagnetic wave, which has irradiation intensity higher than that of the first electromagnetic wave, to the dot to which the first electromagnetic wave is emitted. When the main-curing irradiation section emits the second electromagnetic wave, a dot forming surface of the medium faces the lower side in the direction of gravity.

6 Claims, 8 Drawing Sheets

LIQUID EJECTING APPARATUS

This application is a Continuation of application Ser. No. 12/828,829, filed Jul. 1, 2010, which is expressly incorporated herein by reference. The entire disclosure of Japanese Patent Application No. 2009-158044, filed Jul. 2, 2009 is expressly incorporated by reference herein.

BACKGROUND

1. Technical Field

The present invention relates to a liquid ejecting apparatus.

2. Related Art

Liquid ejecting apparatuses that perform printing by using liquid (for example, UV ink) that is cured by receiving irradiation of electromagnetic waves (for example, ultraviolet rays (UV)) are known. In such liquid ejecting apparatuses, after the liquid is ejected onto a medium (a paper sheet, a film, or the like) from the nozzles of a head, electromagnetic waves are emitted to dots formed on the medium. Accordingly, the dots are cured so as to be fixed to the medium. Therefore, a printing process can be performed well even for a medium that cannot easily absorb liquid (for example, see JP-A-2000-158793).

Among the above-described liquid ejecting apparatuses, there are apparatuses that perform two steps of UV irradiation. First, after formation of dots, the surface portions of the dots are cured, so that ink-gap permeation or expansion of the dots is suppressed (provisional curing process), and thereafter, the ink is completely cured (main curing process). Accordingly, the image quality does not deteriorate regardless of the timing of the main curing process. However, in such a case, dust or mist may adhere to the printing surface (dot forming surface) of the medium before the main curing process is performed.

SUMMARY

An advantage of some aspects of the invention is that it provides a liquid ejecting apparatus capable of preventing adherence of dust or mist.

According to a major aspect of the invention, there is provided a liquid ejecting apparatus including: a head that ejects liquid to be cured by receiving irradiation of an electromagnetic wave onto a medium; a provisional-curing irradiation section that emits a first electromagnetic wave to a dot formed on the medium by the liquid; and a main-curing irradiation section that emits a second electromagnetic wave, which has irradiation intensity higher than that of the first electromagnetic wave, to the dot to which the first electromagnetic wave has been emitted. When the main-curing irradiation section emits the second electromagnetic wave, the dot forming surface of the medium faces the lower side in the direction of gravity.

Other aspects of the invention will become apparent by referring to description as below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

At least the following will be clarified by referring to description as below and the accompanying drawings.

According to a first aspect of the invention, there is provided a liquid ejecting apparatus including: a head that ejects liquid to be cured by receiving irradiation of an electromagnetic wave onto a medium; a provisional-curing irradiation section that emits a first electromagnetic wave to a dot formed on the medium by the liquid; and a main-curing irradiation section that emits a second electromagnetic wave, which has irradiation intensity higher than that of the first electromagnetic wave, to the dot to which the first electromagnetic wave has been emitted. When the main-curing irradiation section emits the second electromagnetic wave, a dot forming surface of the medium faces the lower side in the direction of gravity.

According to the above-described liquid ejecting apparatus, adherence of dust or mist can be prevented.

The above-described liquid ejecting apparatus may further include a working-fluid head that ejects working fluid to be cured by receiving irradiation of an electromagnetic wave. In such a case a working dot is formed by ejecting working fluid from the working-fluid head onto the medium to which the first electromagnetic wave has been emitted, and the second electromagnetic wave of the main-curing irradiation section is emitted to the dot to which the first electromagnetic wave has been emitted and the working dot.

In such a case, the gloss can be increased.

In the above-described liquid ejecting apparatus, when the main-curing irradiation section emits the second electromagnetic wave, the medium may be configured to be tilted in the direction of gravity.

In such a case, the surface on which working dots are formed can be flattened, whereby the gloss can be increased.

The above-described liquid ejecting may further include a cylinder-shaped transport member that transports the medium on a circumferential surface. In such a case, the head and the provisional-curing irradiation section are disposed so as to face the circumferential surface of the transport member, and the main-curing irradiation section is disposed in a position in which a transport path of the medium is detached from the circumferential surface of the transport member.

In such a case, curling of the medium can be prevented.

The above-described liquid ejecting apparatus may further include a transport roller that transports the medium by being brought into contact with the dot forming surface of the medium after the medium is detached from the transport member, wherein the main-curing irradiation section is disposed before the transport roller.

In such a case, liquid is not allowed to adhere to the transport roller.

In the following embodiments, a printer (printer 1) will be described as a liquid ejecting apparatus, as an example.

First Embodiment

Configuration of Printer

Figure 1:
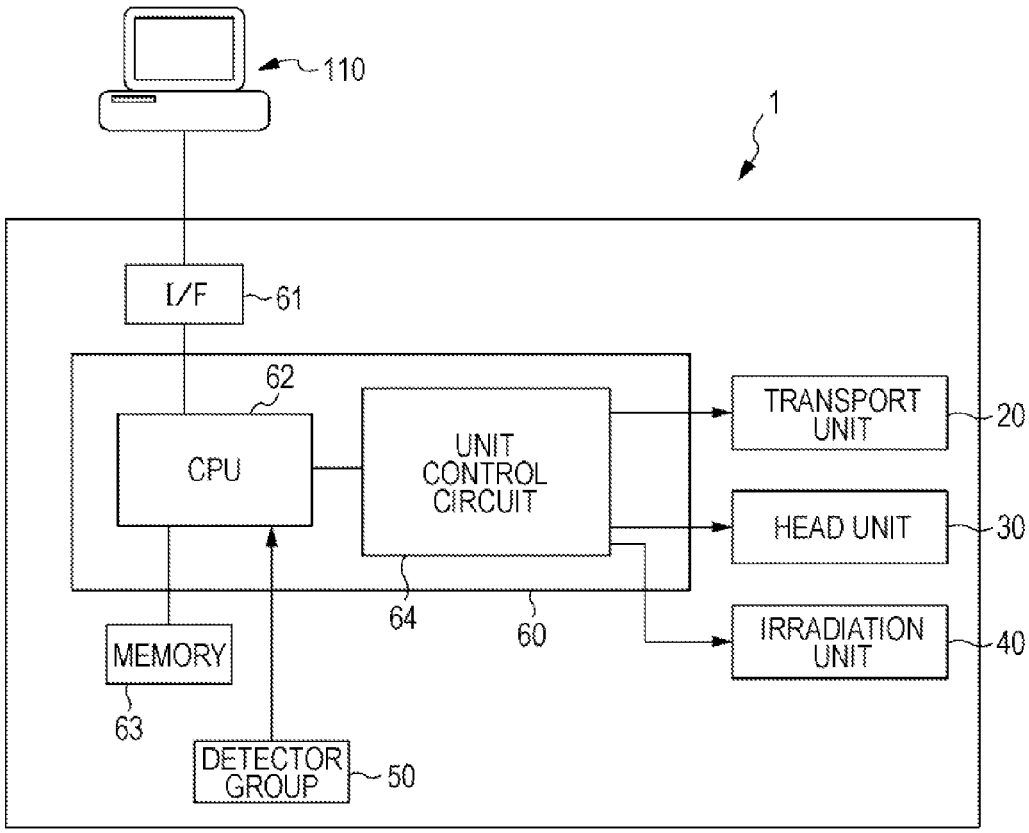
FIG. 1 is a block diagram of the entire configuration of a printer.
Figure 2:
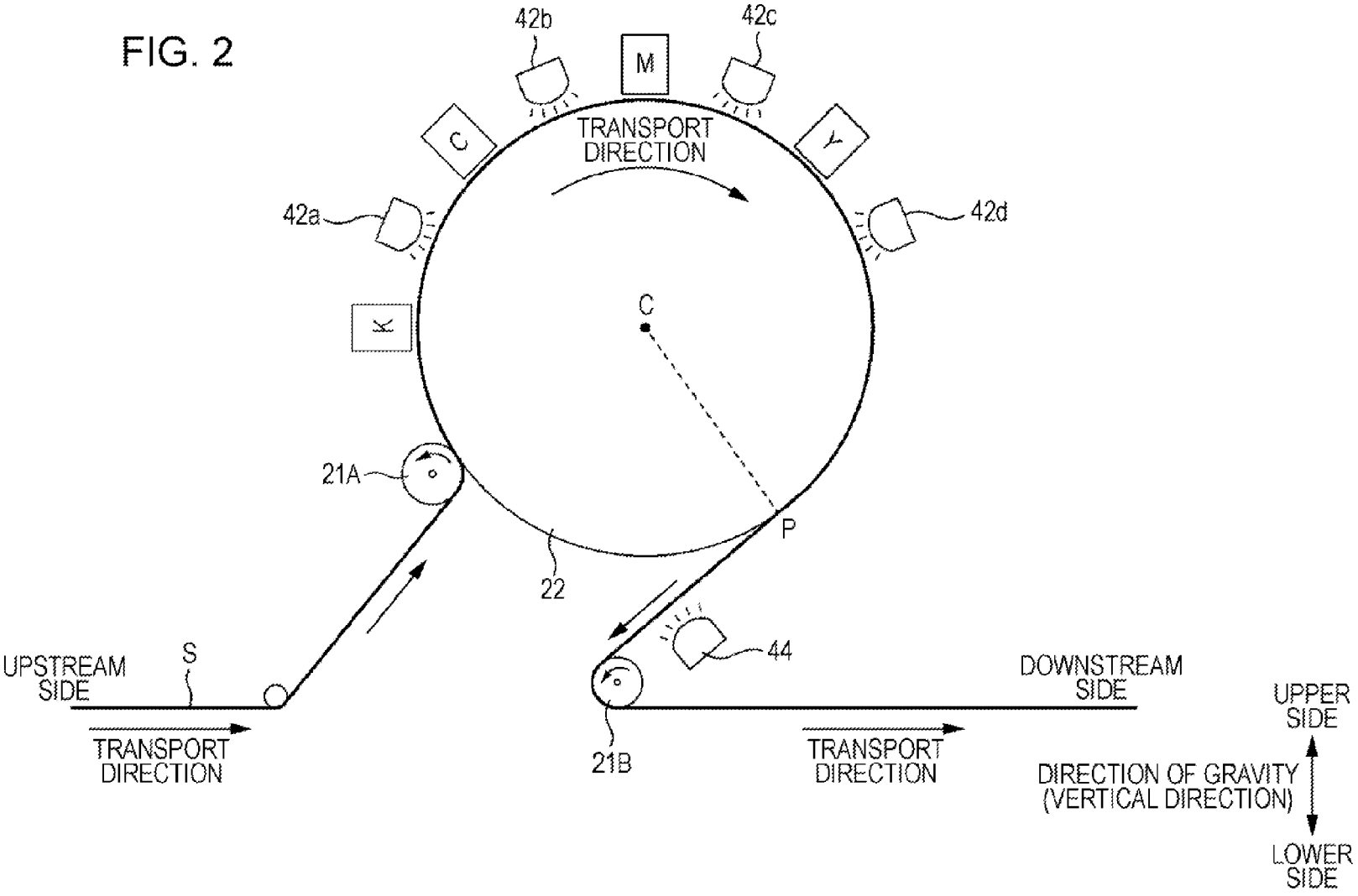
FIG. 2 is a schematic diagram of the periphery of a print area.

FIG. 1 is a block diagram of the entire configuration of a printer 1. In addition, FIG. 2 is a schematic diagram of the periphery of a print area.

The printer 1 is a printing apparatus that prints an image on a medium such as a paper sheet, a cloth, or a film. The printer 1 is connected to a computer 110, which is as an external apparatus, so as to communicate with each other.

In the computer 110, a printer driver is installed. The printer driver is a program that is used for converting image data output from an application program into print data by displaying a user interface in a display device (not shown). This printer driver is recorded on a recording medium (computer-readable recording medium) such as a flexible disk FD or a CD-ROM. Alternatively, the printer driver may be downloaded into the computer 110 through the Internet. This program is composed of codes for implementing various functions.

The computer 110 outputs print data corresponding to a print image to the printer 1 for printing an image by using the printer 1.

The printer 1 of this embodiment is an apparatus that prints an image on a medium by ejecting ultraviolet-curable ink (hereinafter, referred to as UV ink) that is cured by receiving irradiation of an ultraviolet ray (hereinafter, referred to as UV) as an example of liquid thereon. The UV ink is ink that contains ultraviolet-curable resin. When the UV is emitted onto the UV ink, the UV ink is cured due to a photopolymerization reaction in an ultraviolet-curable resin. The printer 1 of this embodiment prints an image by using UV ink (color ink) of four colors of cyan, magenta, yellow, and black.

The printer 1 of this embodiment includes a transport unit 20, a head unit 30, an irradiation unit 40, a detector group 50, and a controller 60. When receiving print data from the computer 110 as an external apparatus, the printer 1 prints an image on a medium based on the print data by controlling each unit (the transport unit 20, the head unit 30, and the irradiation unit 40) by using the controller 60. The controller 60 prints an image on a medium by controlling each unit based on the print data received from the computer 110. The status of the inside of the printer 1 is monitored by the detector group 50, and the detector group 50 outputs the result of detection to the controller 60. Then, the controller 60 controls each unit based on the result of detection that is output from the detector group 50.

The transport unit 20 is used for transporting a medium (for example, a paper sheet S or the like) in a predetermined direction (hereinafter, referred to as a transport direction). This transport unit 20 includes an upstream transport roller 21A, a downstream transport roller 21B, and a transport drum 22.

The upstream transport roller 21A is disposed in a position located on the lower left side of the transport drum 22 in the figure. In addition, the downstream transport roller 21B is disposed on the lower side of the transport drum 22 in the direction of gravity and is detached from the transport drum 22. By rotating the upstream transport roller 21A and the downstream transport roller 21B, the medium is transported, and simultaneously, the transport drum 22 rotates.

The transport drum 22 is a transport member having a cylindrical shape and transports a paper sheet S of a long shape that is wound like a roll on the circumferential surface. In addition, the paper sheet S is supplied from a feed roll (not shown) located on the upstream side and is wound by a wind-up roller (not shown) located on the downstream side. In addition, the paper sheet S is transported with a predetermined tension so as to be tightly brought into contact with the transport drum 22.

The head unit 30 is used for ejecting UV ink onto a medium. The head unit 30 forms dots on the medium by ejecting ink from each head onto a medium, which is in the middle of a transport process, whereby printing an image on the medium. In addition, each head of the head unit 30 of the printer 1 according to this embodiment can form dots corresponding to a medium width at one time. In addition, in this embodiment, as the UV ink, color ink of four colors for forming an image is used. As shown in FIG. 2, in the order from the upstream side in the transport direction, a black ink head K ejecting black UV ink, a cyan ink head C ejecting cyan UV ink, a magenta ink head M ejecting magenta UV ink, and a yellow ink head Y ejecting yellow UV ink are disposed so as to face the circumferential surface of the transport drum 22. Hereinafter, each head that ejects color ink (black, cyan, magenta, or yellow) is referred to as a color ink head. In addition, a dot that is formed by the color ink head is referred to as a color dot.

The configuration of the head unit 30 will be described in detail later.

The irradiation unit 40 emits the UV toward the UV ink landed on a medium. A dot formed on a medium is cured by receiving UV irradiation from the irradiation unit 40. The irradiation unit 40 of this embodiment includes provisional-curing irradiation sections 42*a* to 42*e* and a main-curing irradiation section 44.

The provisional-curing irradiation sections 42*a* to 42*e* emit the UV for performing a provisional curing process for dots formed on the medium. The provisional-curing irradiation section 42*a* is disposed on the downstream side of the black ink head K in the transport direction, and the provisional-curing irradiation section 42*b* is disposed on the downstream side of the cyan ink head C in the transport direction. In addition, the provisional-curing irradiation section 42*c* is disposed on the downstream side of the magenta ink head M in the transport direction, and the provisional-curing irradiation section 42*d* is disposed on the downstream side of the yellow ink head Y in the transport direction. In addition, the provisional-curing irradiation section 42*e* is disposed on the downstream side of a clear ink head CL in the transport direction.

The length of each of the provisional-curing irradiation sections 42*a* to 42*e* in the direction of the medium width is equal to or more than the medium width. The provisional-curing irradiation sections 42*a* to 42*e* can irradiate UV light for performing a provisional curing process for dots that are formed on the medium by the heads. In this embodiment, a provisional curing process is a curing process that is performed for suppressing ink-gap permeation or expansion of a dot.

The provisional-curing irradiation sections 42*a* to 42*e* of this embodiment includes light emitting diodes (LEDs) as light sources of UV irradiation. The LED can change the intensity of irradiation in an easy manner by controlling the magnitude of an input current.

The provisional curing process will be described in detail later.

The main-curing irradiation section 44 emits the UV for performing a main curing process for the dot that is formed on the medium by each head. The main-curing irradiation section 44 is disposed between the transport drum 22 and the downstream transport roller 21B. The reason for disposing the main-curing irradiation section 44 in such a position will be described later. The length of the main-curing irradiation section 44 in the direction of the medium width is equal to or more than the medium width. In this embodiment, the main curing process is a curing process that is performed for completely solidifying the dot.

The main-curing irradiation section 44 of this embodiment includes a lamp (metal halide lamp, a mercury lamp, or the like) as a light source of UV irradiation.

As shown in the figure, the main-curing irradiation section 44 of this embodiment emits the UV for performing the main curing process toward the print surface of the paper sheet S that is interposed between the transport drum 22 and the downstream transport roller 21B.

The main-curing will be described later in detail.

The detector group 50 includes a rotary encoder (not shown), a paper detecting sensor (not shown), and the like. The rotary encoder detects the amount of rotation of the upstream transport roller 21A or the downstream transport roller 21B. The transport amount of a medium can be detected based on the result of detection performed by the rotary encoder.

The controller 60 is a control unit for controlling the printer. The controller 60 includes an interface unit 61, a CPU 62, a memory 63, and a unit control circuit 64. The interface unit 61 performs data transmission and data reception between the computer 110 as an external apparatus and the printer 1. The CPU 62 is an arithmetic processing device for controlling the entire printer. The memory 63 is for acquiring an area in which a program of the CPU 62 is stored, a work area, or the like. The memory 63 includes a memory device such as a RAM or an EEPROM. The CPU 62 controls each unit through the unit control circuit 64 in accordance with the program stored in the memory 63.

Configuration of Head

The printer 1 of this embodiment, as described above, includes four color ink heads (the black ink head K, the cyan ink head C, the magenta ink head M, and the yellow ink head Y). Such heads eject UV ink (color ink), which is used for printing an image, for each ink color.

Figure 3:
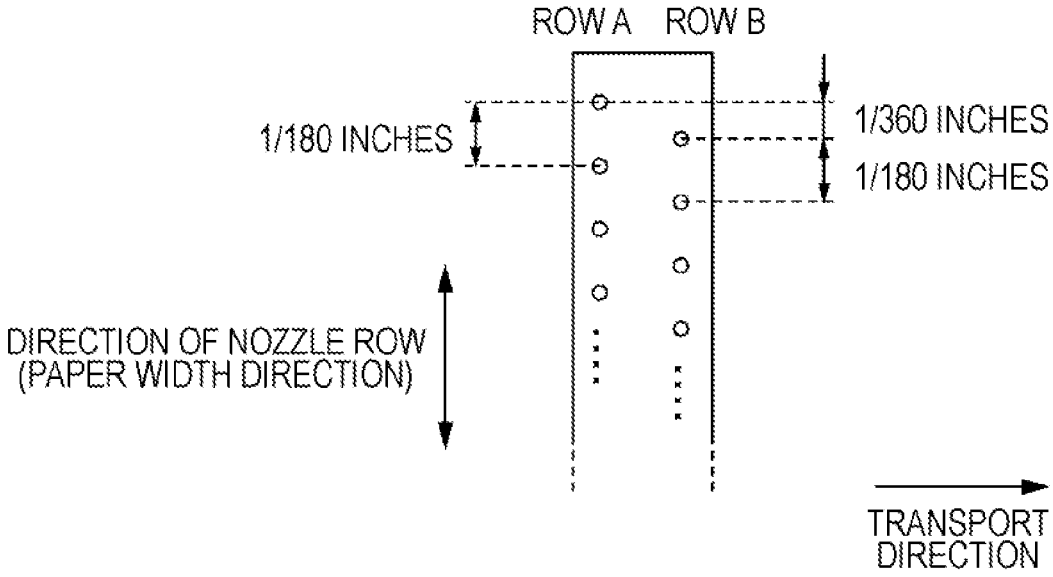
FIG. 3 is a schematic diagram illustrating the nozzle arrangement of each head.

FIG. 3 is a schematic diagram illustrating an example of the nozzle arrangement of each head.

As shown in the figure, each head has two nozzle rows of "A row" and "B row".

The nozzles of each row are aligned at the interval (nozzle pitch) of 1/180 inches along a direction (direction of the nozzle row) intersecting the transport direction. In addition, the position of nozzles of the A row in the direction of the nozzle row and the position of nozzles of the B row in the direction of the nozzle row are deviated by a half nozzle pitch (1/360 inches). Accordingly, color dots can be formed at a resolution of 1/360 inches.

In addition, the length of each nozzle row in the direction of the nozzle row (direction of the paper sheet width) is equal to or more than the medium width. Accordingly, dots corresponding to the medium width can be formed at one time.

Provisional Curing Process and Main Curing Process

The printer 1 of this embodiment includes the provisional-curing irradiation sections 42*a* to 42*d* and the main-curing irradiation section 44 as the irradiation unit 40. The two curing processes, including a provisional curing process and a main curing process, are performed after formation of dots. Hereinafter, the function of each curing process will be described.

The provisional curing process is a curing process for suppressing ink-gap permeation and expansion of dots by curing the surfaces of the dots. The irradiation amount of the UV that is emitted onto dots during the provisional curing process is small, and accordingly, UV ink (dot) is not completely solidified even after the provisional curing process. In addition, the irradiation amount ($mJ/cm^2$) is a product of the irradiation intensity ($mW/cm^2$) and an irradiation time (sec). Since the transport speed of the medium is constant (the irradiation time of each irradiation section is constant) in this embodiment, the irradiation amount depends on the irradiation intensity.

Figure 4A:
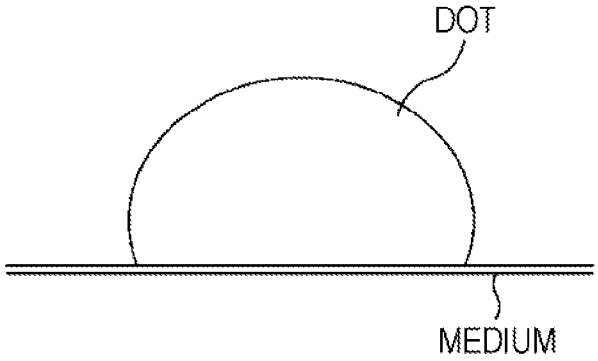
FIGS. 4A to 4C are schematic diagrams illustrating the relationship between the timings of UV irradiation and the shapes of UV ink (dot) in a provisional curing process.
Figure 4B:
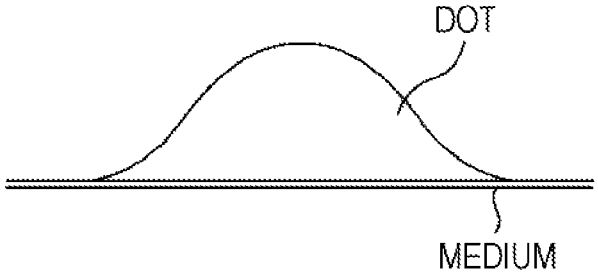
Figure 4C:
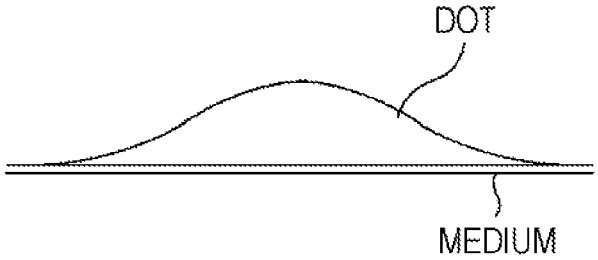

FIGS. 4A to 4C are schematic diagrams illustrating the relationship between the timings of UV irradiation and the shapes of the UV ink (dot) in the provisional curing process. Here, in order of FIGS. 4A, 4B, and 4C, the timings of UV irradiation are sequentially delayed.

In a case where the irradiation timing of the UV is early, for example, the state as shown in FIG. 4A is formed. In such a case, although ink-gap permeation and expansion of dots can be suppressed, the irregularity of the surface of the medium that is configured by the dots is increased, whereby the gloss deteriorates.

On the other hand, in a case where the irradiation timing of the UV is late, for example, the state as shown in FIG. 4C is formed. In such a case, the gloss is good. However, the ink-gap permeation may easily occur.

The main curing process is a curing process for completely solidifying ink. The irradiation amount of the UV in the main curing process is larger than that in the provisional curing process.

By performing the provisional curing process after formation of dots as described above, the ink-gap permeation and the expansion of dots can be suppressed. Accordingly, deterioration of the image quality can be prevented regardless of the timing at which the main curing process is performed. In this embodiment, the provisional-curing irradiation sections are disposed on the downstream sides of the heads of each color in the transport direction, and the provisional curing process is performed right after formation of the color dots.

As described above, in this embodiment, as the light source of the main-curing irradiation section 44, a lamp (for example, a metal halide lamp) is used. The lamp has heat generation higher than that of the LEDs of the light sources of the provisional-curing irradiation sections 42*a* to 42*d*. Accordingly, when the main curing process is performed on the circumferential surface of the transport drum 22, the transport drum 22 is heated by UV irradiation in the main curing process. In addition, since ink is solidified along the circumferential surface of the transport drum, the paper sheet S may curl.

Accordingly, in order to prevent heating of the transport drum 22 and curling of the paper sheet S, it is preferable that the main curing process is performed not on the transport drum 22 but in a flat location separated from the transport drum 22. However, in such a case, there is a high possibility that dust or mist is attached to the medium between the formation of dots (and the provisional curing process) and the main curing process. Here, the mist is a minute ink droplet that is generated in response to the ejection of ink droplets from nozzles of the head. The mist floats in the air and is attached to the head, the medium, or the like, thereby causing contamination.

Thus, in this embodiment, attachment of dust or mist to the medium is prevented. In particular, as shown in FIG. 2, a position (point P) in which the paper sheet S is detached from the transport drum 22 is configured to be on the lower side of the center C of the transport drum 22 in the direction of gravity. In addition, the downstream transport roller 21B is disposed on the left side (the side of the point P that is located on the transport direction) of the point P in the figure and on the lower side of the point P in the direction of gravity, and the print surface of the paper sheet S detached from the transport drum 22 is brought into contact with the downstream transport roller 21B. Accordingly, in the main curing process, the print surface of the paper sheet S is configured to face the lower side in the direction of gravity. Therefore, dust or mist cannot be easily attached to the paper sheet S after formation of dots (and the provisional curing process). In particular, in a case where the head is disposed on the downstream side, in the transport direction, of the uppermost portion (the position in which the magenta ink head M is disposed in FIG. 2) of the circumferential surface of the transport drum 22 in the vertical direction, the mist generated by this head is in the state of being easily attached to the paper sheet S during the paper sheet is transported from the position, in which dots are formed, to the main-curing irradiation section 44 in accordance with the gravitational force. However, the position (point P) in which the paper sheet S is detached from the transport drum 22 is configured to be the lower side of the center C of the transport drum 22 in the direction of gravity, and the main-curing irradiation section 44 is disposed in a position in which the transport path of the paper sheet S is detached from the circumferential surface of the transport drum 22. Accordingly, the dust or mist can be prevented from being attached to the paper sheet S after formation of dots (and the provisional curing process) more assuredly. In addition, the print surface of the paper sheet S faces the lower side in the direction of gravity after the provisional curing process is performed for color dots. Therefore, deterioration (a change in the shape of a dot, permeation, or the like) of the image quality due to gravity cannot easily occur.

Printing Process

When the printer 1 starts printing, a paper sheet S is supported by the upstream transport roller 21A and the downstream transport roller 21B in the state in which the paper sheet S is taken in advance along the circumferential surface of the transport drum 22.

When the printer 1 receives print data from the computer 110, the controller 60 rotates a transport motor, not shown in the figure, at a constant speed. Accordingly, the upstream transport roller 21A and the downstream transport roller 21B rotate at a constant speed in the direction of an arrow shown in the figure. In addition, in accordance with this rotation, the transport drum 22 rotates in the direction of the arrow (transport direction). The paper sheet S that is taken along the circumferential surface of the transport drum 22 and is supported by the upstream transport roller 21A and the downstream transport roller 21B is transported in the transport direction in accordance with the rotation of the transport drum 22. In addition, the paper sheet S in the middle of the transport process is electrostatically adsorbed or vacuum-adsorbed to the transport drum 22.

The controller 60 forms dots on the medium by intermittently ejecting ink from the nozzles of the heads of the head unit 30 based on the print data during when the paper sheet S is transported on the circumferential surface of the transport drum 22, and simultaneously, allows the irradiation sections of the irradiation unit 40 to emit the UV.

Figure 5:
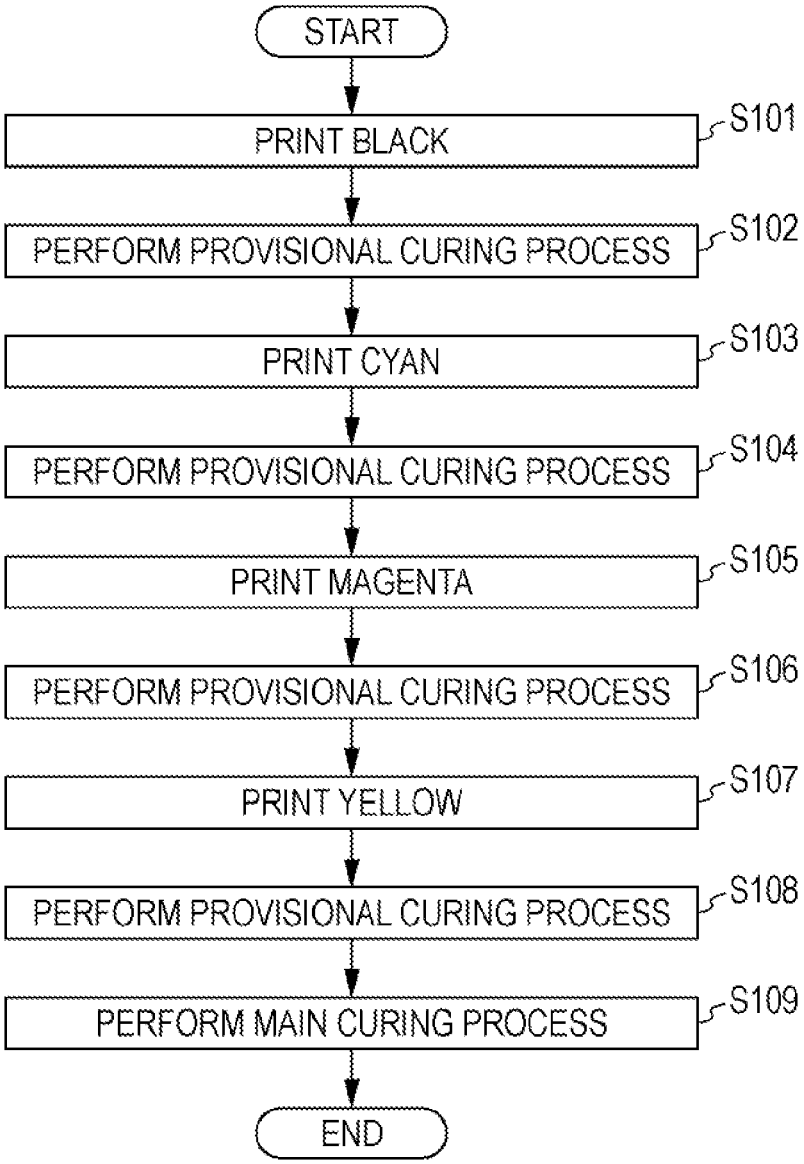
FIG. 5 is a flowchart of a printing process that is performed by the printer of this embodiment.

FIG. 5 is a flowchart of a printing process that is performed by the printer 1 of this embodiment.

First, when the paper sheet S passes below the black ink head K, black is printed by ejecting black ink from the black ink head K (S101). Then, after the printing of black, by emitting the UV from the provisional-curing irradiation section 42*a*, the provisional curing process is performed for the dots formed with black ink (S102).

Next, when the paper sheet S passes below the cyan ink head C, the controller 60 ejects cyan ink from the cyan ink head C, whereby cyan is printed (S103). Then, after the printing, the UV is emitted from the provisional-curing irradiation section 42*b*, whereby the provisional curing process is performed for the dots formed with the cyan ink (S104).

Similarly, the controller 60 ejects magenta ink from the magenta ink head M, whereby magenta is printed (S105). Then, the UV is emitted from the provisional-curing irradiation section 42*c*, whereby the provisional curing process is performed for the dots formed with the magenta ink (S106). In addition, yellow ink is ejected from the yellow ink head Y, whereby yellow is printed (S107). Then, the UV is emitted from the provisional-curing irradiation section 42*d*, whereby the provisional curing process is performed for the dots formed with the yellow ink (S108).

Finally, the controller 60 ejects the UV from the main-curing irradiation section 44, whereby the main curing process is performed for the dots formed on the paper sheet S (S109). At this time, as shown in FIG. 2, the paper sheet S is in a position far from the transport drum 22, and accordingly, is tilted at a specific angle in the direction of gravity. In addition, the print surface of the paper sheet S faces the lower side in the direction of gravity. Then, the UV is emitted from the main-curing irradiation section 44 towards the print surface. As a result, the dots formed on the paper sheet S are completely solidified.

As described above, according to this embodiment, the print surface of the paper sheet S is configured to face the lower side in the direction of gravity in the main curing process, and accordingly, dust or mist cannot be easily attached to the print surface of the paper sheet S.

In addition, according to this embodiment, the main curing process is performed between the transport drum 22 and the downstream transport roller 21B (in a place distant from the transport drum 22). Accordingly, when UV irradiation is performed in the main curing process, the transport drum 22 is not heated.

In addition, according to this embodiment, the paper sheet S is detached from the circumferential surface of the transport drum 22, and the main curing process is performed in the state in which the paper sheet S is straightened. Accordingly, curling of the paper sheet S can be prevented.

In addition, the paper sheet S after the main curing process is transported to the downstream side in the transport direction (the right side in the figure) through the downstream transport roller 21B. At this time, the print surface of the paper sheet S is brought into contact with the downstream transport roller 21B. However, according to this embodiment, the main curing process is performed in front of the downstream transport roller 21B. Accordingly, ink is not allowed to adhere to the downstream transport roller 21B.

Second Embodiment

Figure 6:
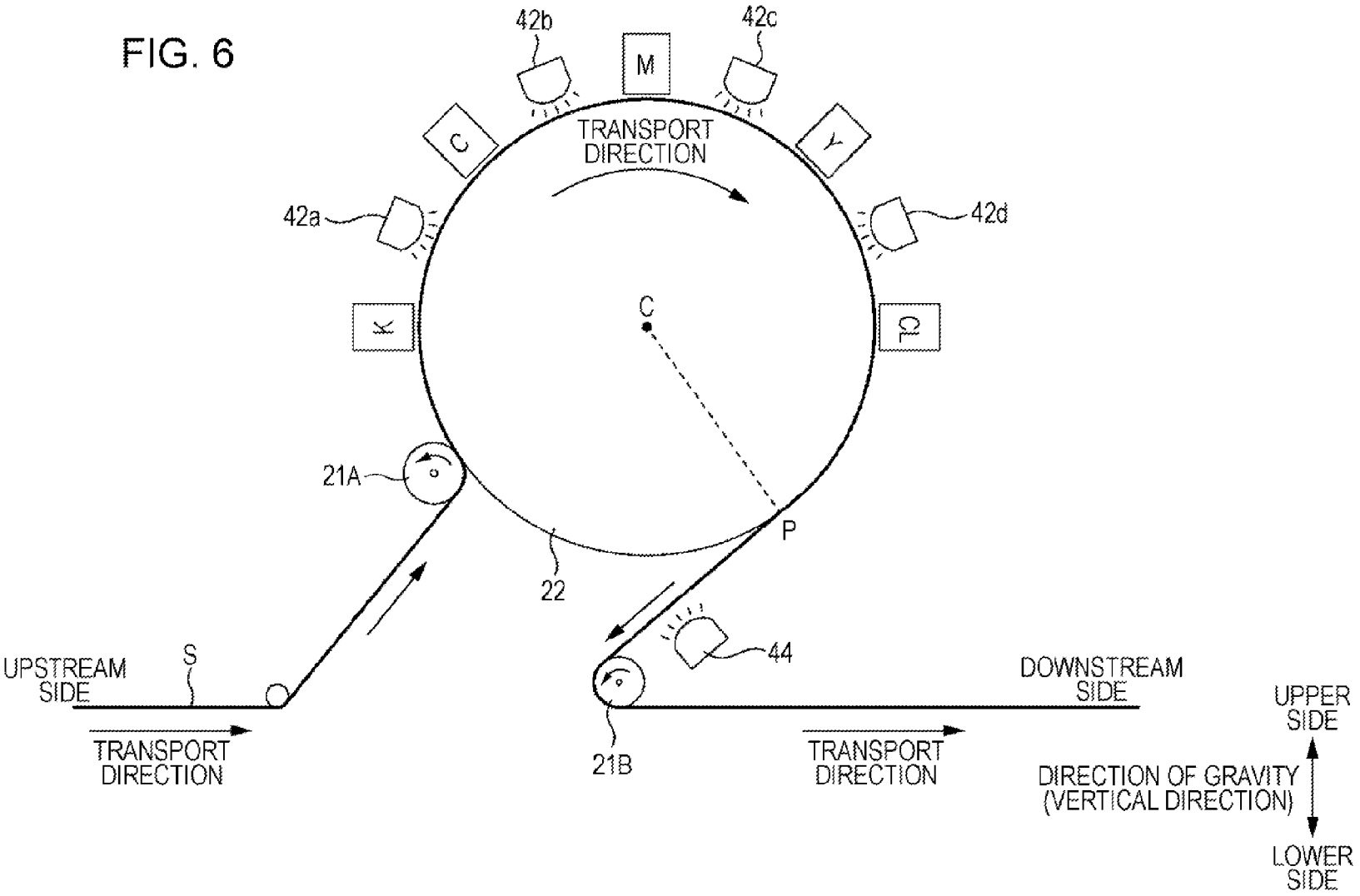
FIG. 6 is a schematic diagram of the periphery of a print area of a second embodiment of the invention.

FIG. 6 is a schematic diagram of the periphery of a print area of a second embodiment of the invention. In FIG. 6, the same reference sign is assigned to a constituent portion that is the same as that shown in FIG. 2, and the description thereof is omitted. The second embodiment is different from the first embodiment (FIG. 2) in that a clear ink head CL is disposed.

The clear ink head CL (it corresponds to a working fluid head) ejects colorless transparent clear ink (one type of working fluid) that is cured by receiving irradiation of UV. The clear ink head CL is disposed on the downstream side of the provisional irradiation section 42*d* in the transport direction so as to face the transport drum 22.

In this second embodiment, after an image is printed (that is, after formation of color dots and the provisional curing process), clear ink is ejected from the clear ink head CL so as to coat the paper sheet S with the clear ink. When the paper sheet S is coated with the clear ink after the printing of an image as described above, gloss of the surface of the medium can be improved.

After the paper sheet is coated with the clear ink, the main-curing process is performed by emitting the UV onto the print surface of the sheet S from the main-curing irradiation section 44.

After the paper sheet S is coated with the clear ink, the provisional process is not performed. The reason for this is as follows. In a case where color ink is mixed together, permeation occurs. However, the clear ink is a colorless transparent ink. Accordingly, when the clear ink is mixed with other color ink, permeation does not occur unlike the case of the color ink. In addition, when the paper sheet is coated with the clear ink, the provisional curing process has been already performed for the color ink (color dot), and accordingly, permeation does not occur between the clear ink and the color ink.

As described above, as the provisional curing process is not performed after the coating of the paper sheet with the clear ink, expansion of the clear ink (clear dot) increases. Accordingly, the surface of the paper sheet S can be flattened, whereby gloss can be improved. In addition, after the coating of the paper sheet with the clear ink, UV irradiation may be performed with the irradiation intensity lower than that of the provisional-curing irradiation sections 42*a* to 42*d*.

State when Main Curing Process is Performed

Figure 7:
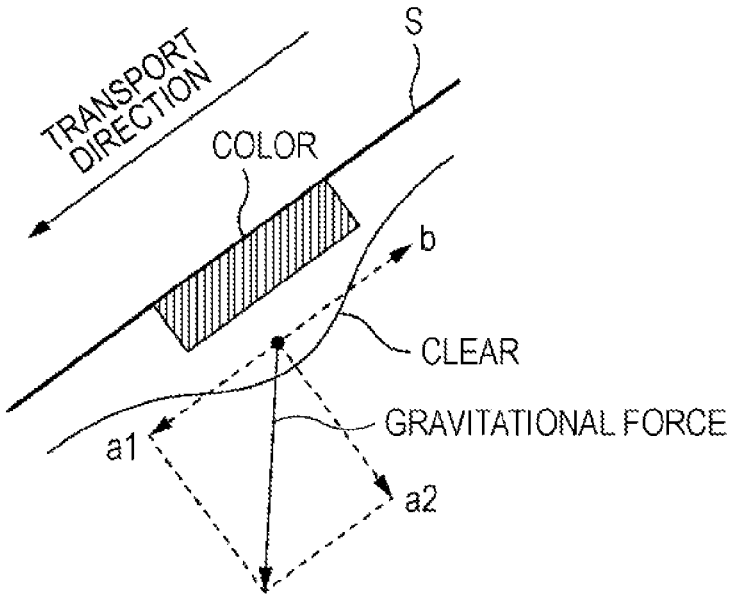
FIG. 7 is a schematic diagram showing the state of a paper sheet at a time when a main curing process is performed, according to the second embodiment.

FIG. 7 is a schematic diagram showing the state of a paper sheet S at a time when the main curing process is performed, according to the second embodiment.

In this embodiment, after the paper sheet S, on which color dots have been formed, is coated with the clear ink, the provisional curing process is not performed for the clear ink (clear dots). Accordingly, the state is formed in which the clear dots can be easily expanded. Here, in the main curing process, as shown in the figure, the print surface of the paper sheet S faces the lower side in the direction of gravity, and the paper sheet S (the transport direction of the paper sheet S) is tilted to the direction of gravity. Accordingly, the gravity working on the dots formed on the medium can be divided into a component force a1 that is parallel to the tilted face of the medium and a component force a2 that is perpendicular to the tilted face. In addition, as the paper sheet S is transported in the transport direction, the clear dots receive air resistance b in the direction opposite to the transport direction. In accordance with such component forces, clear dots are urged to expand. For example, the air resistance b increases as the transport speed becomes higher. On the other hand, as the transport speed becomes lower, the air resistance b decreases. In addition, when the tilt of the paper sheet S toward the direction of gravity increases, the component force a1 is increased, and the component force a2 is decreased. On the other hand, when the tilt toward the direction of gravity decreases, the component force a2 is increased, and the component force a1 is decreased. Accordingly, when the tilt of the paper sheet S in the direction of gravity is increased by raising the transport speed, even in a case where there is a level difference due to a color dot as in the figure, the level difference of the clear ink (clear dot) coated thereon can be decreased. In other words, the surface becomes more flattened, whereby the gloss can be increased.

In this second embodiment, the paper sheet is coated with the clear ink after color dots being formed thereon. Then, after the paper sheet is coated with the clear ink, the print surface of the paper sheet S is configured to face the lower side in the direction of gravity. Accordingly, dust or mist cannot be easily attached on the clear ink (clear dot) of the paper sheet S. In addition, the gloss can be increased due to the clear ink.

In addition, similar to the above-described embodiment, the main curing process is performed in a position far from the transport drum 22. Accordingly, the transport drum 22 is not heated due to UV irradiation in the main curing process, and curling of the paper sheet S can be prevented.

Furthermore, the main curing process is performed before the downstream transport roller 21B. Accordingly, even when the print surface of the paper sheet S is brought into contact with the downstream transport roller 21B, ink is not allowed to adhere to the downstream transport roller 21B.

Third Embodiment

Figure 8:
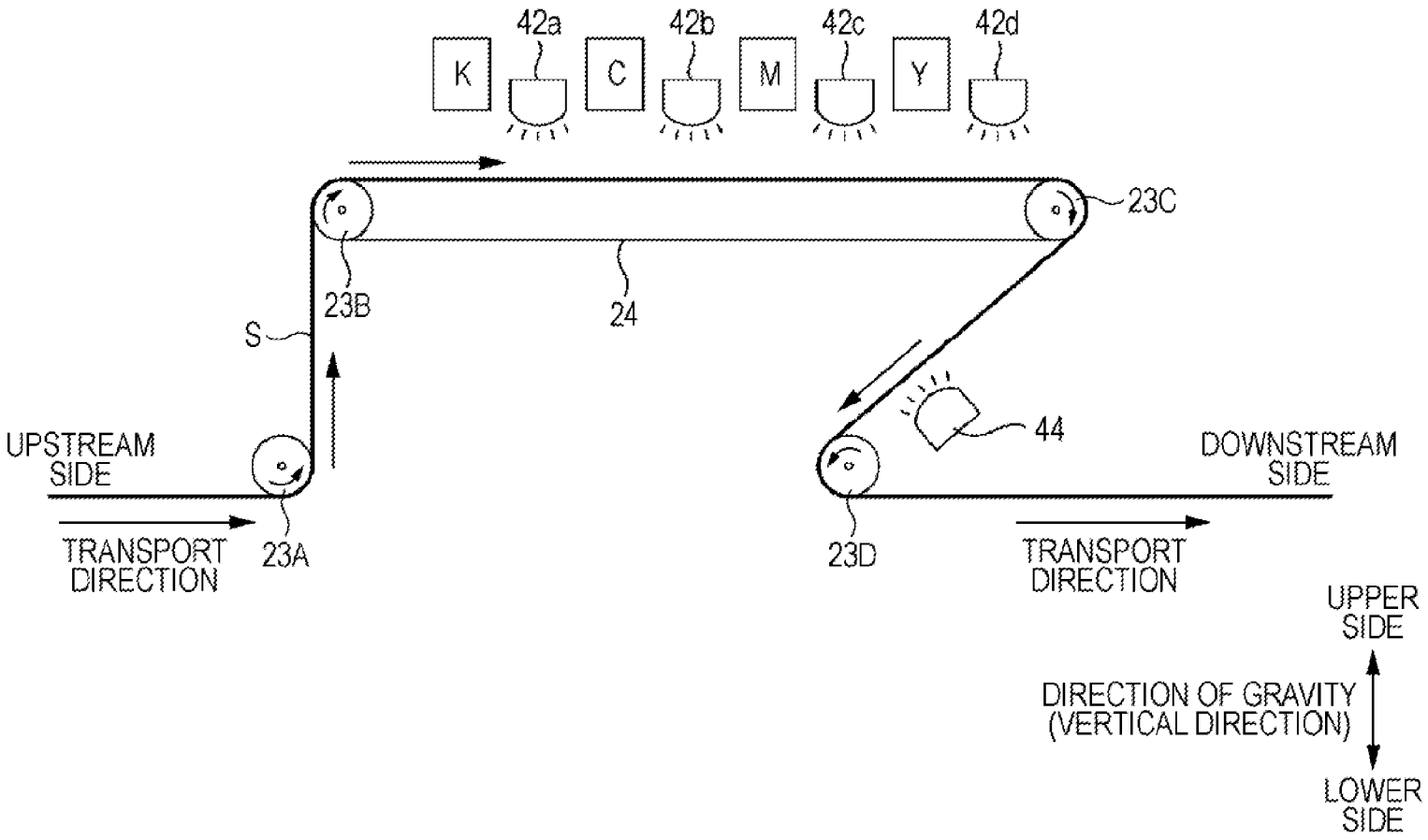
FIG. 8 is a schematic diagram of the periphery of a print area of a third embodiment of the invention.

FIG. 8 is a schematic diagram of the periphery of a print area of a third embodiment of the invention.

The third embodiment is different from the first embodiment in the configuration of the transport unit 20.

The transport unit 20 of the third embodiment includes transport rollers 23A to 23D and a belt 24.

The transport rollers 23A to 23D are rollers that are disposed so as to transport a medium (paper sheet S) of a long shape and rotate in the directions of respective arrows by rotating a transport motor not shown in the figure. In addition, the transport rollers 23A to 23D transport a paper sheet S in the described order. The transport roller 23A is disposed on the uppermost stream side and transports the paper sheet S to the transport roller 23B. The transport roller 23B is disposed on the upper side of the transport roller 23A in the direction of gravity. The transport roller 23C is disposed on the downstream side of the transport roller 23B in the transport direction. In addition, the positions of the transport roller 23B and the transport roller 23C in the direction of gravity are almost the same. The transport roller 23D is disposed on the left side (that is, the direction opposite to the transport direction between the transport rollers 23B to 23C) of the transport roller 23C in the figure and disposed on the lower side of the transport roller 23C in the direction of gravity. Accordingly, between the transport roller 23C and the transport roller 23D, the print surface of the paper sheet S is configured to face the lower side in the direction of gravity.

The belt 24 extends over the transport roller 23B and the transport roller 23C. When the transport roller 23B and the transport roller 23C rotate in a constant direction, the belt 24 rotate in the same direction, whereby rotating the paper sheet S located on the belt 24.

In addition, in the above-described embodiments, the heads (KCMY) for color ink and the provisional-curing irradiation sections 42*a* to 42*d* corresponding to the heads are alternately disposed so as to face the circumferential surface of the transport drum 22. On the other hand, in the third embodiment, the heads (KCMY) and the provisional-curing irradiation sections 42*a* to 42*d* are alternately disposed on the belt 24 in a straight line. In other words, the positions of the heads (KCMY) and the provisional-curing irradiation sections 42*a* to 42*d* in the direction of gravity are almost the same.

In addition, in the third embodiment, the main-curing irradiation section 44 is disposed between the transport roller 23C and the transport roller 23D. As shown in the figure, here, the paper sheet S is tilted in the direction of gravity, and the print surface faces the lower side in the direction of gravity. Then, in order to perform the main-curing process for the dots formed on the paper sheet S, UV for the main-curing process is emitted from the main-curing irradiation section 44 toward the print surface of the print sheet S (obliquely upwardly). As described above, when the main curing process is performed, the print surface of the print sheet S faces the lower side in the direction of gravity. Accordingly, similarly to the above-described embodiments, attachment of dust or mist to the print surface of the print sheet S can be prevented.

Furthermore, in this embodiment, the main curing process is performed before arrival the paper sheet S at the transport roller 23D. Accordingly, even when the print surface of the print sheet S is brought into contact with the transport roller 23D, ink is not allowed to adhere to the transport roller 23D.

Printing Process

When the printer 1 starts printing, a paper sheet S is supplied from a feed roll (not shown) located on the upstream side in advance and is delivered to a downstream-side wind-up roller (not shown) through the transport rollers 23A to 23D.

When the printer 1 receives print data from the computer 110, the controller 60 rotates a transport motor (not shown) at a constant speed. Then, the transport rollers 23A to 23D rotate in the respective directions of arrows shown in the figure based on the rotation of the transport motor. In addition, the belt 24 rotates in accordance with the rotation of the transport rollers 23B and 23C. The paper sheet S is transported based on the rotation of the transport rollers 23A to 23D and the belt 24. In addition, as the belt 24 transports the paper sheet S, the paper sheet S moves in the transport direction with respect to the head unit 30. The paper sheet S that is in the middle of the transport process is electrostatically adsorbed or vacuum-adsorbed to the belt 24.

While the paper sheet S is transported on the belt 24, the controller 60 performs printing of an image based on the print data by ejecting ink from each head. In addition, right after the dots are formed by each head, the controller 60 emits UV for the provisional curing process from the corresponding provisional-curing irradiation section. In addition, the order of the formation of color dots and the provisional curing process is the same as those presented in the above-described embodiments, and thus, the description thereof is omitted.

Finally, the controller 60 emits UV for the main curing process from the main-curing irradiation section 44 toward the paper sheet S passing through the transport roller 23C and having the print surface facing the lower side in the direction of gravity. Accordingly, the dots are completely solidified.

Similarly to the above-described embodiments, according to the third embodiment, when the main curing process is performed, the print surface of the print sheet S faces the lower side in the direction of gravity. Accordingly, attachment of dust or mist to the print surface of the print sheet S can be prevented. In addition, the main curing process is performed before the transport roller 23D. Accordingly, even when the print surface of the paper sheet S is brought into contact with the transport roller 23D, ink is not allowed to adhere to the transport roller 23D.

In addition, similarly to the second embodiment, the clear ink head CL may be disposed on the downstream side of the provisional-curing irradiation section 42*d* in the transport direction so as to coat the paper sheet S with the clear ink. Even in such a case, when the main curing process is performed, the paper sheet S is tilted in the direction of gravity. Accordingly, the irregularity of dots formed by the clear ink is decreased. Therefore, the surface of the paper sheet S is flattened, and the gloss can be increased.

Other Embodiments

Printers and the like have been described as embodiments of the invention. However, the embodiments are not for limiting the scope of the invention but for easy understanding of the invention. Thus, it is apparent that the invention may be changed or modified without departing from the concept of the invention, and equivalents thereof also belong to the scope of the invention. In particular, embodiments described below also belong to the scope of the invention.

Printer

In the above-described embodiments, printers have been described as an example of an apparatus. However, the invention is not limited thereto. For example, technology that is the same as disclosed in the embodiments may be applied to various printing apparatuses that apply ink jet technology such as a color filter manufacturing apparatus, a coloring apparatus, a fine processing apparatus, a semiconductor manufacturing apparatus, a surface processing apparatus, a three-dimensional molding apparatus, a liquid vaporization apparatus, an organic EL manufacturing apparatus (in particular, a high-molecular EL manufacturing apparatus), a display manufacturing apparatus, a deposition system, and a DNA chip apparatus.

Ink

In the above-described embodiments, ink (UV ink) that is cured by receiving irradiation of ultraviolet rays (UV) is ejected from the nozzles. However, the liquid that is ejected from the nozzles is not limited thereto. Thus, liquid that is cured by receiving electromagnetic waves (for example, visible light) other than UV may be configured to be ejected from the nozzles. In such a case, electromagnetic waves (visible light or the like) for curing the liquid may be configured to be ejected from the provisional-curing irradiation section and the main-curing irradiation section.

Clear Ink

In the second embodiment, colorless transparent clear ink is used for forming dots other than dots of an image. However, the invention is not limited thereto. For example, a semi-transparent working fluid that enables the surface of a medium to have gloss may be used. In addition, the processing may be performed not for the gloss. Thus, working fluid that adjusts the texture of the surface of a medium may be used.

What is claimed is:

1. A liquid ejecting apparatus comprising:

a transport member that transports a medium;

a first head that ejects a first liquid to be cured by receiving irradiation of an electromagnetic wave onto the medium;

a first light source that emits a first electromagnetic wave to a first dot formed on the medium by the first liquid; and a second light source that emits a second electromagnetic wave to the first dot to which the first electromagnetic wave has been emitted, the second light source being positioned to irradiate the first dot at a location where the medium is detached from the transport member, wherein an irradiation amount of the second electromagnetic wave in the second light source is larger than an amount of the first electromagnetic wave in the first light source, and wherein, when the second light source emits the second electromagnetic wave, a surface of the medium that includes the first dot to which the first electromagnetic wave has been emitted faces downward in the direction of gravity.

2. The liquid ejecting apparatus according to claim 1, further comprising:

a second head that ejects a second fluid to be cured by receiving irradiation of an electromagnetic wave, wherein a second dot is formed by ejecting the second fluid from the second head onto the medium to which the first electromagnetic wave has been emitted, and wherein the second electromagnetic wave of the second light source is emitted to the first dot to which the first electromagnetic wave has been emitted and the second dot.

3. The liquid ejecting apparatus according to claim 2, wherein the first light source being disposed on the downstream side of the first head in a transport direction of the medium, wherein the second head being disposed on the downstream side of the first light source in the transport direction, and wherein the second light source being disposed on the downstream side of the second head in a transport direction.

4. The liquid ejecting apparatus according to claim 3, wherein the first liquid is color ink and the second ink is clear ink.

5. The liquid ejecting apparatus according to claim 1, wherein the transport member is a transport roller.

6. The liquid ejecting apparatus according to claim 1, wherein the transport member is a transport drum.

* * * * *